US006040277A

United States Patent [19]

Caporiccio

[11] Patent Number: 6,040,277

[45] Date of Patent: Mar. 21, 2000

[54] GREASE COMPOSITIONS EMPLOYING FLUORINATED POLYMER OILS AND HEXAGONAL LATTICE BORON NITRIDE

[75] Inventor: Gerardo Caporiccio, Milan, Italy

[73] Assignee: Dow Corning Corporation, Midland, Mich.

[21] Appl. No.: 08/207,512

[22] Filed: Mar. 8, 1994

[30] Foreign Application Priority Data

Sep. 13, 1993 [IT] Italy ..... MI93A1965

[51] Int. Cl.[7] ..... C10M 125/26

[52] U.S. Cl. ..... 508/155; 508/590

[58] Field of Search ..... 252/25, 18, 58; C10M 113/00, 113/100

[56] References Cited

U.S. PATENT DOCUMENTS

| | | | |
|---|---|---|---|
| 3,525,690 | 8/1970 | Christian . | |
| 3,525,960 | 8/1970 | Christian | 252/25 |
| 3,658,709 | 4/1972 | Christian | 252/51.5 R |
| 3,801,505 | 4/1974 | Hong | 252/25 |
| 4,324,673 | 4/1982 | Christian et al. | 252/51.5 R |
| 4,691,065 | 9/1987 | Dannels | 570/139 |
| 5,100,568 | 3/1992 | Takahashi et al. | 252/28 |
| 5,210,123 | 5/1993 | Caporiccio | 524/263 |
| 5,227,081 | 7/1993 | Sawa et al. | 252/28 |

FOREIGN PATENT DOCUMENTS

| | | |
|---|---|---|
| 0479200 | 4/1992 | European Pat. Off. . |
| 0558099 | 9/1993 | European Pat. Off. . |
| 62-043493 | 2/1987 | Japan . |

OTHER PUBLICATIONS

Database WPI, Section CH, Week 7930, Derwent Publications Ltd., London, GB; Class A60, AN 79–55316B.

*Primary Examiner*—D. Gabrielle Brouillette
*Assistant Examiner*—Cephia D. Toomer
*Attorney, Agent, or Firm*—Roger E. Gobrogge

[57] ABSTRACT

Disclosed are grease compositions containing a liquid fluorinated polymer and a thickening agent containing hexagonal lattice boron nitride powder having a bimodal particle size distribution as well as grease compositions containing a liquid fluorinated polymer and a thickening agent containing hexagonal lattice boron nitride powder and a solid fluorinated polymer.

11 Claims, No Drawings

GREASE COMPOSITIONS EMPLOYING FLUORINATED POLYMER OILS AND HEXAGONAL LATTICE BORON NITRIDE

BACKGROUND OF THE INVENTION

The present invention relates to novel grease compositions which contain fluorinated oils, boron nitride powders and, optionally, solid fluorinated polymers. Such compositions have been found to have exceptionally good lubricating properties, even under severe conditions.

Boron nitride powders are known to be employed because they lower the coefficient of friction of metals which move in contact with one another. The use of hexagonal lattice boron nitride (HLBN) powder in grease compositions based on silicon oils is also known in the art. For instance, Japanese patent J62043493 discloses a grease composition comprising a polyorganosiloxane and boron nitride powder. This reference, however, does not disclose the use of a fluorinated polymer oils, the combination of a solid fluorinated polymer with boron nitride for fluorinated greases, nor a bimodal distribution of boron nitride.

Similarly, United States Air Force report ASDTDR 63-656, part 1, titled "Rheology of Silicone Fluids Thickened with Boron Nitride" (1963) discloses grease compositions comprising a hydrogenated silicone fluid with a density of 1.02 g/ml combined with boron nitride powders. It is disclosed therein that 43.2 to 43.9 weight percent of a standard coarse grain boron nitride is required to form a consistent grease while only 14.5 to 19.7 weight percent of a submicron particle size boron nitride is necessary to form desirable greases. This reference, however, does not describe the use of a fluorinated silicone fluid since the density of fluorinated silicone fluid exceeds 1.02 g/mL (it is about 1.3 g/mL), the use of boron nitride powder having a bimodal particle size distribution, nor the combination of a fluorinated polymer with boron nitride for obtaining fluorinated greases based on fluorinated polymer oils.

The problem to be solved by the present invention is to find grease compositions based on boron nitride having exceptionally good lubricating properties even under severe operating conditions. The solution has been found by the grease compositions as described below.

BRIEF DESCRIPTION OF THE INVENTION

The present invention relates to a novel grease composition containing between 55 and 95 weight percent of a liquid fluorinated polymer oil and between 5 and 45 weight percent of a thickener comprising boron nitride powder. The boron nitride powder is characterized as having a bimodal particle size distribution in which between 25 and 75 weight percent of the boron nitride is an aggregate powder having an average particle size in the range of from 2 to 50 micrometers and between 75 and 25 weight percent of the boron nitride is a fine powder having an average particle size in the range of from 0.01 to 1 micrometers.

The present invention also relates to a novel grease composition containing between 55 and 95 weight percent of a liquid fluorinated polymer oil and between 5 and 45 weight percent of a thickener comprising boron nitride powder and a solid fluorinated polymer.

DETAILED DESCRIPTION OF THE INVENTION

The present invention is based on the discovery that boron nitride having a bimodal particle size distribution provides unexpectedly superior lubricating properties when compared with similar greases containing conventional boron nitride powders. The invention is also based on the discovery that boron nitride in combination with a solid fluorinated polymer is a valuable thickening agent for fluorinated greases based on fluorinated polymer oils.

As noted above, the thickening agent in the grease of the present invention contains hexagonal lattice boron nitride (HLBN). In a preferred embodiment, the HLBN has a bimodal particle size distribution.

If a bimodal particle size distribution HLBN is used, between 25 and 75 weight percent of this powder comprises aggregate particles having an average particle size of 2–50 micrometers (+/−20%). Such particles generally have a surface area of 1–15 square meters/g. Preferred are aggregate powders in which between 40 and 60 weight percent, and most preferably 50 weight percent, of this powder has an average particle size of 5–15 micrometers (+/−20%) and a surface area of 3–10 square meters/g.

The remainder of the bimodal HLBN, i.e., between 75 and 25 weight percent, comprises a fine powder which has an average particle size of 0.01–1 micrometers (+/−20%). Such powder generally has a surface area of 15–150 square meters/g. Preferred are fine powders in which between 60 and 40 weight percent, and most preferably 50 weight percent, of the powder has an average particle size of 0.1–0.5 micrometers (+/−20%) and a surface area of 25–90 square meters/g.

HLBN is known in the art and can be produced, for example, by heating boric oxide and ammonia. HLBN is also commercially available from Kawasaki Steel Corporation. Particle size determinations can he made by sieving or by counting particles and by measuring the sizes.

Generally, the bimodal particle size distribution is obtained by merely mixing aggregate powder and fine powder with the above described properties. Such mixing can be performed in any conventional manner such as in a powder mixer.

The thickening agent may also contain a conventional fluorinated thickening agent and most are commercially available. The amount of this conventional fluorinated thickening agent can vary over a very broad range, eg., the weight ratio of HLBN/fluorinated thickening agent is 0.1 to 10, preferably 0.25 to 4. Examples of such conventional fluorinated thickening agents include polytetrafluoroethylene (PTFE), the copolymer of tetrafluoroethylene and hexafluoropropene, the copolymer of tetrafluoroethylene and perfluoropropylvinylether, the copolymer of vinylidene fluoride and hexafluoroisobutylene and blends of the above polymers. One skilled in the art would recognize that other equivalent thickening agents or mixtures thereof would also function herein.

As stated above, these conventional thickening agents are known in the art. For example, the PTFE which may be used herein can include a series of products marketed under the trade name VYDAX™ by E. I. du Pont (Wilmington, Del.). Such polymers may be produced by polymerization of tetrafluoroethylene in the presence of chain transfer agents, such as $CCl_4$, and typically have number average molecular weights up to about 100,000, preferably up to about 50,000. Polymers of this type may be obtained as a dispersion in a fluorocarbon solvent, such as FREON™ F113, or in dry powder form obtained from the said dispersion in FREON™ F113 or from an aqueous dispersion of the medium molecular weight PTFE.

Another example of commercial PTFE suitable herein is the polymer obtained by thermal or gamma ray degradation of high molecular weight PTFE or mechanical grinding thereof. Such polymers typically have number average molecular weights on the order of $10^4$ to $10^6$.

Yet another example of commercial PTFE which may be included herein is obtained by emulsion polymerization and subsequent precipitation so as to provide a fine powder. Aggregates of the powder can be readily broken down by passing a liquid suspension of the powder through a two- or three-roll mill. Specific examples of this type of PTFE micro-powder are manufactured by I.C.I. (England), Hoechst (W. Germany), L.N.P. (Malvern, Pa.) and DuPont (Wilmington, Del.).

The copolymer of tetrafluoroethylene and hexafluoropropene can be produced, for example, by the copolymerization of tetrafluoroethylene and hexafluoropropene in the presence of trichloroacetyl peroxide at low temperatures. Such a process is described in U.S. Pat. No. 2,598,283. Other approaches such as emulsion polymerization under conditions described above for PTFE are also generally effective.

The copolymer of tetrafluoroethylene and perfluoropropylvinyether can be produced, for example, by the copolymerization of tetrafluoroethylene and perfluoropropylvinylether in aqueous or non-aqueous media. In aqueous copolymerization, water soluble initiators and a perfluorinated emulsifying agent are used. In non-aqueous copolymerization, fluorinated acyl peroxides which are soluble in the copolymerization medium are used as initiators. These processes are described, for example, in U.S. Pat. Nos. 3,132,123, 3,635,926, and 3,536,733.

The vinylidene fluoride-hexafluoroisobutylene copolymer powder which may be used herein is known in the art and may be prepared, for example, by methods outlined in U.S. Pat. No. 3,706,723. Generally, this copolymer has a molar ratio of alternating vinylidene fluoride units to hexafluoroisobutylene units of about 1:1. The number average molecular weight of this copolymer is generally at least 50,000 and the melting point is preferably above 300° C. This copolymeric powder generally has an average particle size between 2 and 100 micrometers, preferably between 5 and 50 micrometers.

The above boron nitride powder and conventional thickening agent, if used, are suspended in a fluorinated polymer lubricant liquid. Representative examples of such fluorinated oils include telomers of chlorotrifluoroethylene, fluorosilicone polymers, and perfluoropolyethers.

The liquid telomers of chlorotrifluoroethylene useful herein generally have a viscosity in the range of from 0.00001 to 0.001 square meters/second at 40° C. These compounds are known in the art and have the general structure $CX_3(C_2F_3Cl)_nX'$ or $Cl(C_2F_3Cl)_nCl$, in which X and X' are independently selected from fluorine or chlorine, with the proviso that at least one X is chlorine, and n is sufficient to impart the above viscosity range at 40° C. Liquid telomers of this type are produced commercially by Halocarbon Products Corp. (Hackensack, N.J.) and Atochem (France).

The liquid fluorosilicone useful herein generally have a viscosity from 0.00003 to 0.01 square meters/second at 25° C. and can be a homopolymer of siloxane units represented by the formula (a)

(a)

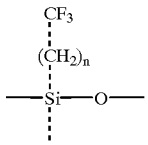

or a copolymer of these siloxane units with siloxane units represented by the formula (b)

(b)

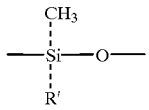

In the above formulas, n is an integer between 2 and 3, R is a monovalent hydrocarbon radical selected from the group consisting of an alkyl radical having 1 to 6 carbon atoms, a cyclohexyl group and a phenyl group and R' is a monovalent hydrocarbon radical selected from the group consisting of methyl, phenyl and chlorophenyl. When such fluorosilicones contain siloxane units (b), no more than 50 mole percent of the (b) units should be present. Preferably, the fluorosilicone is a homopolymer consisting essentially of the (a) siloxane units having a viscosity of 0.0003 to 0.002 square meters/second at 25° C. For the purpose of the present invention, the terminal groups of the fluorosilicone are not critical and can be such groups as trimethylsiloxy, dimethylphenylsiloxy or dimethyltrifluoropropylsiloxy.

These fluorosilicone polymers and copolymers are well known in the art and some are available commercially from, e.g., Dow Corning Corp. (Midland, Mich.).

The liquid perfluoropolyethers useful herein generally have a viscosity from 0.00003 to 0.01 square meters/second at 20° C. These perfluoropolyethers are well known in the art and may be illustrated by the following structures:

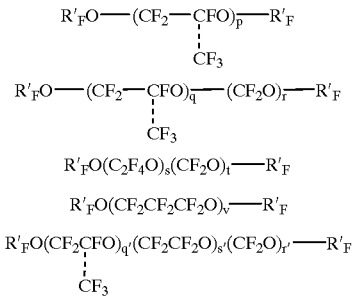

In these formulas, $R'_F$ is an independently selected perfluoroalkyl radical having 1 to 3 carbon atoms (i.e., $—CF_3$, $—CF_2CF_3$ or $—C_3F_7$). The values of the subscripts p, q, r, s, t, v, q', s' and r' are such as to place the viscosity of the above perfluoropolyethers within the above stated range of 0.00003 to 0.01 square meters/second at 20° C., with the further proviso that the ratio q/r is between 10 and 1,000, the ratio s/t is between 0.5 and 5 and the ratio r'/r'+s'+q' is, or equal to 1/10, r'+s'+q' is such to give the viscosity indicated and q'/s' is from 0.2 to 6.

All of the above perfluoropolyethers are known in the art and some are available commercially from, for example, E. I. du Pont (Wilmington, Del.) or Daikin (Japan). Others can be produced according to the methods disclosed in British patent GB 1,104,482, Italian patent IT 933,753 and European Patent Applications EP 0344547 and EP 0340793 of Ausimont S.r.l.

In general, the fluorinated liquid lubricant is selected from one of the compounds. However, 2 to 5 weight percent of the telomer of chlorotrifluoroethylene having the proper viscosity can be blended with one of the perfluoropolyethers. It should be noted that the recommended viscosity ranges of each liquid lubricant described above should generally be followed. When the viscosity of the fluid falls below this range, the resulting composition is too "runny" and not suitable for use as a grease. Similarly, when the fluid viscosity is above the range, the grease is too stiff and leads to application difficulties.

The compositions of the present invention contain between 5 and 45 parts by weight of the thickening agent and between 55 and 95 parts by weight of the fluorinated polymer liquid. Preferably, the compositions of the present invention contain between 10 and 40 parts by weight of the thickening agent and between 60 and 90 parts by weight of the liquid fluorinated polymer lubricant. This formulation may, however, be modified by the addition of other components commonly employed in the art such as dispersing or wetting agents, antiwear agents and protective agents for metals.

An example of a suitable surfactant is the class of perfluorinated neutral salts represented by the general formula $R_FAM$, wherein $R_F$ has its above defined meaning, A is a monovalent anionic group selected from $—SO_3^-$ or $—COO^-$ and M is a cation, such as $Na^+$ and $K^+$. Specific examples include $C_7F_{15}COONa$ and $C_8F_{17}SO_3K$. The surfactant, which is generally employed to improve the stability of the grease with respect to phase separation, is typically added in a proportion of 0.1 to 1% by weight of the weight of the thickening agent.

Examples of antirust or metal protective agents include the following compositions which help protect metal bearing surfaces exposed to aggressive environments:

(1) mixtures of $NaNO_2$, $NaNO_3$ and MgO in a ratio of 2 to 20 parts by weight of $NaNO_2$ for 1 part of $NaNO_3$ and 1 part by weight of MgO per 10 to 50 parts of the sodium salts. These mixtures are typically added in a proportion of 0.01 to 5 parts by weight per 100 parts of the thickening agent.

(2) mixtures of 0.1 to 3 parts by weight of benzotriazole and 0.05 to 5 parts of MgO (optionally in the presence of 0.05 to 1.5 parts by weight of KOH) per 100 parts of thickening agent.

(3) 1 to 2 parts by weight of the barium or zinc salt of a dialkylnaphthalenesulfonic acid, such as dinonylnaphthalenesulfonic acid or dodecylnaphthalenesulfonic acid, per 100 parts of thickening agent.

(4) 0.2 to 2 parts by weight of triphenylphosphine or tripentafluorophenylphosphine per 100 parts of the thickening agent.

(5) 1 to 10 parts by weight of $MOS_2$as antiwear agent per 100 parts of thickening agent.

(6) 0.5 to 1 part by weight of a heat stabilizer such as an oxide of zinc, calcium or magnesium per 100 parts of thickening agent.

Compositions of the invention may be prepared according to methods used in the art to manufacture conventional polytetrafluoroethylene-thickened greases. Thus, for example, the thickening agent(s) may be mixed with one or more of the above described additives (if desired) in a low shear mixer, such as a two Z-blade mixer, preferably under vacuum. After any additives employed are mixed with the thickening agent, the liquid fluorinated polymer is introduced and a homogeneous dispersion is obtained by mixing these components at temperatures of 50 to 180° C. for 2–6 hours. The grease is then allowed to reach room temperature and it is preferably further processed in a three-roll mill (eg., output gap of 0.5 mm in order to improve the suspension stability, thus providing a more stable formulation.

The grease compositions of the present invention exhibit exceptionally good resistance to fatigue and high load-carrying capacity when use, to lubricate metal bearings subjected to sliding, oscillatory or rotational motion. These compositions thus find particular utility in bearings subjected to high loads, high speed or to an extraordinary degree of vibration. Moreover, the greases of the invention show high resistance to high temperature and operate effectively in oxidative or chemically aggressive environments.

The following examples are provided so that one skilled in the art may better understand the invention.

EXAMPLE 1

A jacketed 1 liter mixer equipped with 2 z-shaped mixing blades and parts for the introduction of liquids and for the removal of air or volatile components was charged with 1 part by weight of benzotriazole, 2 parts by weight of MgO and 20 parts by weight of hexagonal lattice boron nitride. The boron nitride was a 50:50 weight mixture of an aggregate powder with an average particle size of 5–15 micrometers and a fine powder with an average particle size of 0.1–0.5 micrometers, both obtained from Kawasaki Steel Corporation, Japan. These powders were mixed while the jacket was heated to 50° C. And one of the vessel's ports was connected to a vacuum to remove air from the voids of the powder. To this mixture was added 77 parts by weight of a perfluoropolyether liquid having the average formula:

$$R'_FO—(CF_2—\underset{\underset{CF_3}{|}}{CFO})_p—R'_F$$

wherein the $R'_F$ groups consisted of $—CF_3$ and $—CF_2CF_3$ and the viscosity of said perfluoropolyether was 0.0015 square meters/second at 20° C. The resulting mixture was stirred for another 8 hours at 20° C. and then for 3 hours as the temperature was increased from 50 to 180° C. The mixture was then allowed to cool to room temperature and a stable grease was obtained. The grease was then twice passed through a 3-roll mill with a gap setting of 20 micrometers.

The final grease had a consistency corresponding to National Lubricants and Grease Institute (NLGI) degree 2, as determined by a modified ASTM D1403 penetration test method. Oil separation of the grease at 200° C./30 hours was approximately 14% according to United States Federal Test Method Standard FTMS 791,321.

The above grease was subjected to a shell 4-ball extreme pressure test ASTMD 2596-87 (10 seconds at 100° C.) and it showed a welding load higher than 800 kg and the wear scar under a load of 400 kg was 0.94 mm (10 sec).

EXAMPLE 2

Following the procedure of Example 1, a grease was manufactured by homogenizing 16 parts by weight of a copolymer of vinylidene fluoride and hexafluoroisobutylene (1:1) mole ratio as available as CM-X Fluoropolymer, 16 parts by weight of an aggregate HLBN powder with an average particle size of 5–15 micrometers obtained from Kawasaki Steel Corporation, Japan, 1 part by weight of benzotriazole, 2 parts by weight of MgO and 65 parts by weight of the perfluoropolyether of Example 1.

The grease showed an oil separation at 200° C./30 hours of 16.8% according to US FTMS 791,321 and a welding load of 560 Kg under the shell 4-ball extreme pressure test ASTMD 2596-87 (10 seconds at 100° C.). The grease was tested on the FALEX machine at the N.C.T. (National Center of Tribology of Riscley UK) operating at 100° C. and 290 rpm showed a failure load of 953 kg.

A pair of stainless steel bearings lubricated with the above grease and mounted on a shaft that was rotated at 3000 rpm and had an applied axial load of 200 N survived 1540 hours at 200° C.

EXAMPLE 3

Following the procedure of Example 1, a grease was manufactured by homogenizing 12.4 parts by weight of the bimodal distribution HLBN powder of Example 1, 1 part by weight of benzotriazole, 2 parts by weight of MgO, 24.8 parts by weight of polytetrafluoroethylene Type TL102 (manufactured according to ICI-LNP) and 59.8 parts by weight of methyl-3,3,3-trifluoropropylpolysiloxane having a viscosity of 0.001 square meters/second at 25° C.

The final grease had a consistency corresponding to National Lubricants and Grease Institute (NLGI) degree 2, as determined by a modified ASTM D1433 penetration test method. Oil separation of the grease at 200° C./130 hours was approximately 2.1% according to United States Federal Test Method Standard FTMS 791,321.

EXAMPLE 4

Following the procedure of Example 1, a grease was manufactured by homogenizing 8.8 parts by weight of the bimodal distribution HLBN powder of Example 1, 1 part by weight of benzotriazole, 2 parts by weight of MgO, 17.6 parts by weight of polytetrafluoroethylene Type TL102 (manufactured according to ICI-LNP) and 70.6 parts by weight of the perfluoropolyether of Example 1.

The final grease had an oil separation at 200° C./30 hours of 8.3% according to United States Federal Test Method Standard FTMS 791,321. The grease was subjected to a shell 4-ball extreme pressure test ASTMD 2596-87 (10 seconds at 100° C.) and it showed a welding load of 800 kg and a wear scar under a load of 400 kg of 1 mm (10 sec). The survival test of the bearings described in Example 2 carried out with greases of Example 4 showed a duration of more than 840 hours at 200° C.

EXAMPLES 5 AND 6 (Comparative)

Two greases were formulated according to the method of Example 1 using the ingredients listed in the following table in the parts by weight indicated therein and also comprising 1 part by weight of benzotriazole and 2 parts by weight of MgO.

| EX No | Aggregate HLBN pwdr[1] | Fine HLBN Pwdr[2] | PTFE[3] | PFPE[4] | Weld Load[5] |
|---|---|---|---|---|---|
| 5 | 10.5 | — | 21 | 65 | 500 Kg |
| 6 | — | 8.3 | 16.6 | 72.1 | 620 Kg |

-continued

| EX No | Aggregate HLBN pwdr[1] | Fine HLBN Pwdr[2] | PTFE[3] | PFPE[4] | Weld Load[5] |
|---|---|---|---|---|---|

[1]aggregate powder with an/average particle size of 5–15 microns
[2]fine powder with an average particle size of 0.1–0.5 microns
[3]polytetrafluoroethylene of Example 3
[4]perfluoropolyether of Example 1
[5]as determined by shell 4-ball extreme pressure test ASTMD 2596-87 (10 seconds at 100° C.)

The survival test of the bearings described in Example 2 carried out with greases of Example 6 showed a duration of more than 1100 hours at 200° C.

That which is claimed is:

1. A grease composition comprising:

(A) between 5 and 45 weight percent of a thickening agent comprising boron nitride powder having a bimodal particle size distribution in which between 25 and 75 weight percent of the boron nitride has an average particle size in the range of from 2 to 50 micrometers and between 75 and 25 weight percent of the boron nitride has an average particle size in the range of from 0.01 to 1 micrometer; and (b) between 55 and 95 weight percent of a liquid fluorinated polymer oil.

2. The grease of claim 1 wherein the thickening agent is present in an amount of between 10 and 40 weight percent and the liquid fluorinated polymer is present in an amount of between 60 and 90 weight percent.

3. The grease of claim 1 wherein the boron nitride has a particle size distribution in which between 40 and 60 weight percent of the boron nitride has an average particle size in the range of from 2 to 50 micrometers and between 60 and 40 weight percent of the boron nitride has an average particle size in the range of from 0.01 to 1 micrometer.

4. The grease of claim 1 wherein the boron nitride has a particle size distribution in which 50 weight percent of the boron nitride has an average particle size in the range of from 5 to 15 micrometers and 50 weight percent of the boron nitride has an average particle size in the range of from 0.1 to 0.5 micrometer.

5. The grease of claim 1 wherein the boron nitride has a particle size distribution in which between 40 and 60 weight percent of the boron nitride has an average particle size in the range of from 5 to 15 micrometers and between 60 and 40 weight percent of the boron nitride has an average particle size in the range of from 0.1 to 0.5 micrometer.

6. The grease of claim 1 wherein the thickening agent also contains a material selected from the group consisting of polytetrafluoroethylene, the copolymer of tetrafluoroethylene and hexafluoropropene, the copolymer of tetrafluoroethylene and perfluoropropylvinylether, the copolymer of vinylidene fluoride and hexafluoroisobutylene and blends of the above.

7. The grease of claim 1 wherein the liquid fluorinated polymer comprises a telomer of chlorotrifluoroethylene which has a viscosity in the range of from 0.00001 to 0.001 square meters/second at 40° C. and the general structure $CX_3(C_2F_3Cl)_nX'$ or $Cl(C_2F_3Cl)_nCl$, in which X and X' are independently selected from fluorine or chlorine, with the proviso that at least one X is chlorine, and n is sufficient to impart a viscosity in the range of from 0.00001 to 0.0001 square meters/second at 40° C.

8. The grease of claim 1 wherein the liquid fluorinated polymer comprises a fluorosilicone which has a viscosity from 0.00003 to 0.01 square meters/second at 25° C. and units selected from the group consisting of:

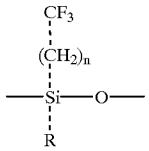

and a mixture of siloxane units of the structure:

(a)

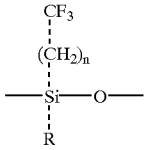

and (b)

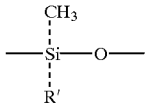

wherein n is an integer between 2 and 3, R is a monovalent hydrocarbon radical selected from the group consisting of an alkyl radical having 1 to 6 carbon atoms, a cyclohexyl group and a phenyl group and R' is a monovalent hydrocarbon radical selected from the group consisting of methyl, phenyl and chlorophenyl, with the proviso that when such fluorosilicones contain siloxane units (b), no more than 50 mole percent of the (b) units are present.

9. The grease of claim 1 wherein the liquid fluorinated polymer comprises a perfluoropolyether which has a viscosity from 0.00003 to 0.01 square meters/second at 20° C.

10. The grease of claim 8 wherein the liquid fluorinated polymer comprises a perfluoropolyether which has a structure selected from the group consisting of

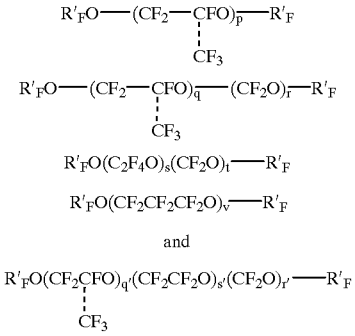

wherein $R'_F$ is an independently selected perfluoroalkyl radical having 1 to 3 carbon atoms and p, q, r, s, t, v, q', s' and r' are integers which provide the material with a viscosity in the range of 0.00003 to 0.01 square meters/second at 20° C., with the proviso that the ratio q/r is between 10 and 1,000, the ratio s/t is between 0.5 and 5 and the ratio r'/r'+s'+q' is less than or equal to 1/10 and q'/s' is from 0.2 to 6.

11. The grease of claim 1 which also contains an agent selected from the group consisting of dispersing agents, wetting agents, antiwear agents and protective agents for metals.

* * * * *